United States Patent [19]

Wu

[11] Patent Number: 4,641,675

[45] Date of Patent: Feb. 10, 1987

[54] SPORT'S CAP UMBRELLA

[76] Inventor: Bing T. Wu, 12137 Front St., Norwalk, Calif. 90650

[21] Appl. No.: 747,800

[22] Filed: Jun. 24, 1985

[51] Int. Cl.[4] ..... A45B 11/00; A45B 3/00; A45B 19/00

[52] U.S. Cl. ..... 135/20 A; 135/16; 135/25 R

[58] Field of Search ..... 135/16, 25 R, 25 A, 135/35 R, 35 S, 36 R, 36 V, 31, 20 A

[56] References Cited

U.S. PATENT DOCUMENTS

| | | | |
|---|---|---|---|
| 100,012 | 2/1870 | Caldwell | 135/25 |
| 160,214 | 2/1875 | Martin | 135/25 |
| 229,464 | 6/1880 | Ray | 135/16 |
| 559,144 | 4/1896 | Müller | 135/22 |
| 850,341 | 4/1907 | Callahan | 135/31 |
| 869,082 | 10/1907 | Hays | 135/22 |
| 1,067,435 | 7/1913 | McNamara | 135/22 |
| 1,577,227 | 3/1926 | Greenwald | 135/31 |
| 1,581,843 | 4/1926 | Little, Sr. | 135/35 S |
| 1,718,417 | 6/1929 | Greenberg | 135/25 R |
| 2,024,105 | 12/1935 | Landman | 135/35 S |
| 2,841,160 | 6/1958 | DeWispelere | 135/35 S |
| 4,131,954 | 1/1979 | Brock et al. | 135/16 X |
| 4,597,400 | 7/1986 | Trudeau, Sr. | 135/18 |

FOREIGN PATENT DOCUMENTS

| | | | |
|---|---|---|---|
| 1380763 | 10/1964 | France | 135/31 |

*Primary Examiner*—Robert A. Hafer
*Assistant Examiner*—D. Neal Muir
*Attorney, Agent, or Firm*—Harpman & Harpman

[57] ABSTRACT

An umbrella configured in the shape of a cap, having a main canopy from which extends about a portion of the lower perimeter a brim canopy when in opened and extended position. The brim canopy folds upwardly against the main canopy as it is closed.

3 Claims, 5 Drawing Figures

SPORT'S CAP UMBRELLA

BACKGROUND OF THE INVENTION

1. Technical Field

This invention relates to umbrellas and parasols that have a center support shaft from which extends a plurality of ribs secured to the top of the shaft. A plurality of deployment ribs are secured to the ribs and slide up and down the shaft extending the ribs which are covered by a water-repellent material.

2. Description of the Prior Art

Prior art devices of this type have been well developed over the years with the basic structural configuration of the umbrella well-defined and well understood by those skilled in the art.

SUMMARY OF THE INVENTION

An umbrella that is configured in the shape of a sport's related headgear when opened, having a conventional umbrella canopy with the addition of a brim canopy extending outwardly from a portion of the lower perimeter of the canopy. Specialized support ribs define the brim canopy without interfering with the working of the conventional portion of the umbrella deployment structure.

DESCRIPTION OF THE PREFERRED EMBODIMENT

Figure 4:
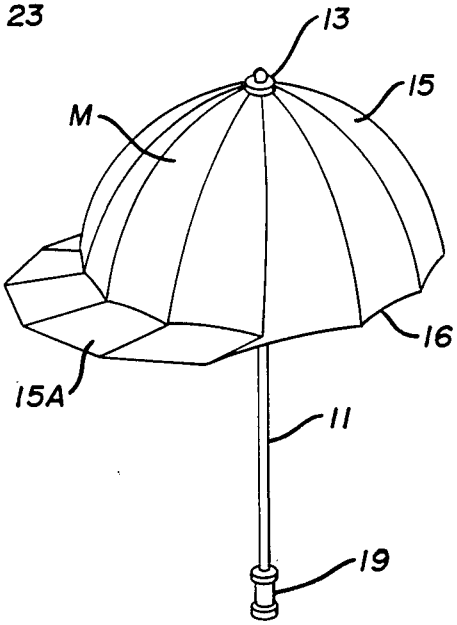
FIG. 4 is a perspective view of the umbrella fully deployed.

Referring to FIG. 4 of the drawings, a sport's cap umbrella 10 can be seen having a shaft 11 with a crown 13 on one end and a handle grip 14 on the other end. An umbrella canopy 15 extends from the crown on a generally arcuate configuration downwardly around the shaft 11 being spaced in relation thereto at the canopy's perimeter 16. A brim canopy 15A extends outwardly from a portion of the canopy's perimeter 16 on a horizontal plane defining a curved brim best seen in FIGS. 4 and 5 of the drawings.

Figure 1:
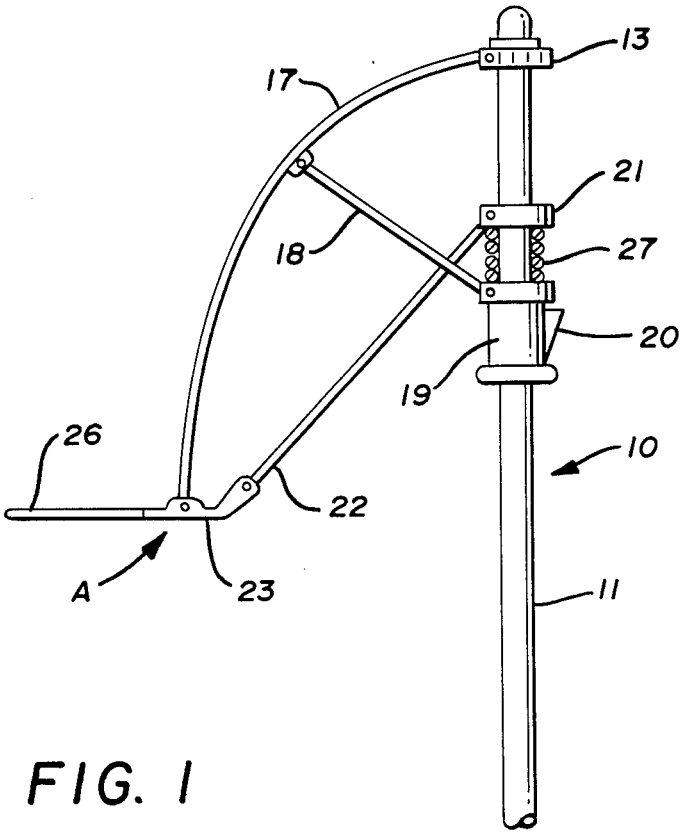
FIG. 1 is a side plan view of a single support rib system and deployment mechanism in open position.
Figure 2:
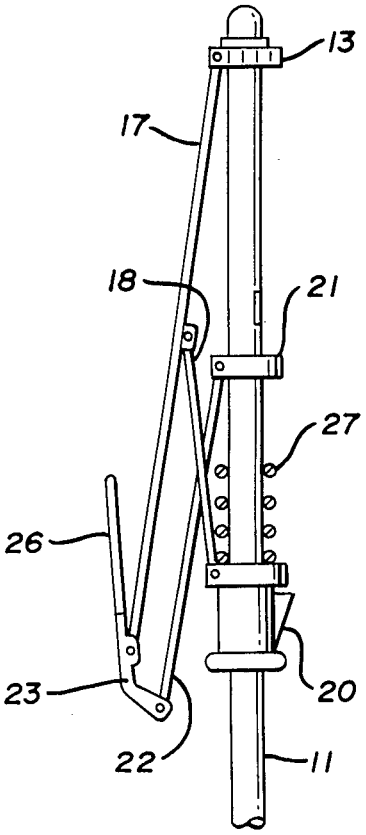
FIG. 2 is a side plan view of a single support rib system and deployment mechanism in closed position.

Referring now to FIGS. 1 and 2 of the drawings, a portion of the shaft 11 can be seen with the crown 13 having a plurality of canopy support ribs 17 pivotally secured therefrom in spaced radial pattern. Each of the ribs are cross sectionally U-shaped for strength and flexibility which is common in the umbrella support technology. A plurality of deployment arms 18 are pivotally extended from a spool-type sleeve 19 movably positioned on the shaft 11. Each of the deployment arms 18 are pivotally secured at their free end to a respective canopy support rib 17 at a point defined by approximately one-third their overall length from said crown 13. A spring urged lock arm 20 is located in the spool sleeve 19 and is designed to engage an aperture in the shaft 11 adjacent the crown 13 so as to lock the spool sleeve to the shaft at the desired position extending the canopy support ribs 17 into an open position as seen in FIG. 1 of the drawings.

It will be apparent to those skilled in the art that the structure thus described is that of a conventional umbrella and that further elaboration on such a well known structure is not required.

Figure 3:
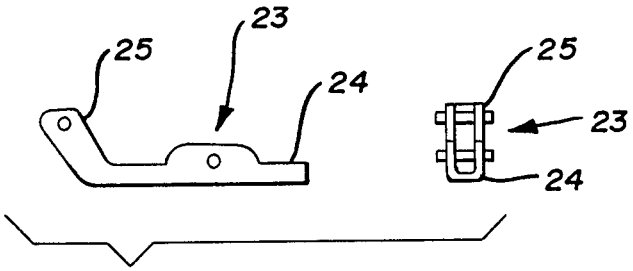
FIG. 3 is an enlarged view of a portion of the support rib system.

An annular ring 21 is movably positioned on the shaft 11 between the spool-type sleeve 19 and the crown 13. A plurality of brim canopy deployment support arms 22 are pivotally secured to and extend from said annular ring 21. A rib connector fitting 23 best seen in FIGS. 1, 2 and 3 of the drawings has a cross sectionally U-shaped body member 24 with an angularly disposed end portion 25 with enlarged apertured sections defined at end portion 25 and midway along the body member 24.

Figure 5:
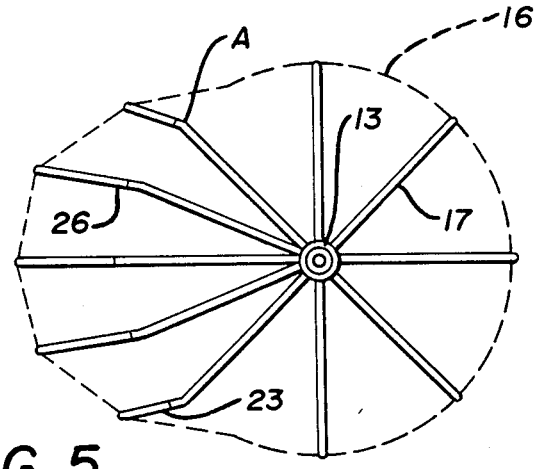
FIG. 5 is a top plan view of the umbrella showing the support rib system.

Each rib connector fitting 23 is pivotally secured to each of the free ends of all of the brim canopy deployment support arms 22 and a select group of the canopy support ribs 17 adjacent the brim canopy deployment support arms 22. This relationship is best seen in FIGS. 1 and 5 of the drawings at A.

A plurality of brim ribs 26 are secured to the free ends of the rib connector fitting 23. At least two of the brim ribs 26 are of a length less than that of the other of said brim ribs. The brim ribs 26 support and define the brim canopy 15A as seen in FIGS. 4 and 5 of the drawings.

In operation, material M is fitted over the ribs 17 as in a conventional umbrella. The brim canopy 15A has a separate material covering which is attached to the bottom perimeter edge of said material M.

Referring now to FIG. 2 of the drawings, the sport's cap umbrella is shown in a closed configuration with the brim ribs 23 pivoted upwardly in a generally vertical alignment parallel the shaft 11. The spool-type sleeve 19 is advanced upwardly on the shaft 11 towards the crown 13. A spring 27 is positioned on the shaft between the annular ring 21 and the sleeve 19 and is moved up the shaft as the sleeve 19 is advanced. The spring 27 eventually engages the annular ring 21 moving the same upwardly which in turn extends the brim ribs 26 pivoting at A. The spring 27 compresses slightly against the annular ring 21 as the lock arm 20 registers in the aperture in the shaft effectively locking the spool type sleeve 19 on the shaft 11 near the crown 13. The canopy support ribs 17 are now in open position as best seen in FIGS. 1, 4 and 5 of the drawings with the material M stretched tightly across the ribs. The canopy brim 15 is also extended as hereinbefore described.

To close the sport's cap umbrella, the above outlined procedure is reversed; unlocking the spool-type sleeve 19 and moving the same downwardly the shaft, collapsing the deployment arms and canopy ribs, etc.

Thus it will be seen that a new and useful improvement to an umbrella has been illustrated and described and it will be apparent to those skilled in the art that various changes and modifications may be made therein without departing from the spirit of the invention.

Having thus described my invention, what I claim is:

1. An improvement for an umbrella, the umbrella having a support shaft, a handle on the shaft a canopy defined by a plurality of canopy support ribs and a rib deployment mechanism which includes a sleeve slidably mounted on the support shaft with the canopy support ribs being attached to the sleeve, a water repellent material secured to and over said canopy support ribs, the improvement comprising a brim canopy extended around a portion of the perimeter of the canopy, the brim canopy comprising a number of brim ribs, separate material covering said brim canopy brim ribs and which is attached to the perimeter portion of the canopy, said brim canopy further including a rib connector fitting attached at one end thereof to one end of each brim rib and at a midportion thereof to one end of a canopy support rib and having a second end bent inwardly and upwardly to form a crank, said brim canopy further including a ring slidably mounted on said support shaft above said sleeve between said sleeve and said canopy, and a plurality of brim canopy support arms each attached at one end thereof to a rib connector second end and at another end thereof to said ring, some of said brim ribs having a length less than other of said brim ribs said sleeve moving on said shaft to operate said canopy and results in the extension of said brim canopy.

2. The improvement for an umbrella of claim 1 wherein said means for moving said support arms and pivotally retaining support arms comprises a locking mechanism on said sleeve engageable on said shaft.

3. The improvement in an umbrella as defined in claim 1 wherein said improvement further includes a spring on said support shaft, said spring being located to separate said ring from said sleeve.

* * * * *